US009685081B2

(12) United States Patent
Grieco et al.

(10) Patent No.: US 9,685,081 B2
(45) **Date of Patent: *Jun. 20, 2017**

(54) TRAFFIC LIGHT PREEMPTION MANAGEMENT SYSTEM

(75) Inventors: Giovanni Grieco, Rome (IT); Benedetta Guidi, Rome (IT); Michelangelo La Placa, Rome (IT); Riccardo Pizzutilo, Rome (IT)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 3 days.

This patent is subject to a terminal disclaimer.

(21) Appl. No.: 13/416,167

(22) Filed: Mar. 9, 2012

(65) Prior Publication Data

US 2012/0161981 A1 Jun. 28, 2012

Related U.S. Application Data

(63) Continuation of application No. 13/289,456, filed on Nov. 4, 2011.

(30) Foreign Application Priority Data

Nov. 5, 2010 (EP) ..... 10190263

(51) Int. Cl.

| | |
|---|---|
| ***G08G 1/07*** | (2006.01) |
| ***G08G 1/087*** | (2006.01) |
| ***G08G 1/04*** | (2006.01) |
| ***G08G 1/0967*** | (2006.01) |

(52) U.S. Cl.

CPC ..... *G08G 1/087* (2013.01); *G08G 1/04* (2013.01); *G08G 1/096716* (2013.01); *G08G 1/096741* (2013.01); *G08G 1/096775* (2013.01)

(58) Field of Classification Search

None

See application file for complete search history.

(56) References Cited

U.S. PATENT DOCUMENTS

| | | | | | |
|---|---|---|---|---|---|
| 4,443,783 | A * | 4/1984 | Mitchell | G08G 1/087 | 340/13.3 |
| 4,573,049 | A * | 2/1986 | Obeck | G08G 1/087 | 340/12.5 |
| 4,785,474 | A * | 11/1988 | Bernstein | G08B 1/08 | 324/76.31 |
| 5,287,411 | A * | 2/1994 | Hill | G08G 1/087 | 340/902 |

(Continued)

OTHER PUBLICATIONS

U.S. Appl. No. 13/289,456, Non-Final Office Action, Aug. 20, 2013, 14 pg.

(Continued)

*Primary Examiner* — Curtis King

(74) *Attorney, Agent, or Firm* — Cuenot, Forsythe & Kim, LLC

(57) ABSTRACT

A method and system for managing a set of traffic lights at an intersection, measuring the Doppler Effect of a signal emitted by a vehicle, where such Doppler Effect being a function of the vehicle movement with respect to said intersection, and deciding as a function of such measure a new state for each traffic light at the intersection so as to facilitate passage of the approaching vehicle.

5 Claims, 4 Drawing Sheets

(56) References Cited

U.S. PATENT DOCUMENTS 5,345,232 A * 9/1994 Robertson ..... G08G 1/087 340/286.14
5,495,242 A * 2/1996 Kick ..... G08G 1/087 340/902
5,710,555 A * 1/1998 McConnell ..... G08G 1/0965 340/902
5,889,475 A * 3/1999 Klosinski ..... G08G 1/0965 340/902
6,064,319 A * 5/2000 Matta ..... G08G 1/087 340/902
6,326,903 B1 * 12/2001 Gross ..... G08G 1/087 340/902
8,094,040 B1 * 1/2012 Cornett ..... G08G 1/087 340/902
2004/0195508 A1 * 10/2004 Moisel ..... B60R 1/00 250/330
2005/0023465 A1 * 2/2005 Eggers ..... B60R 1/00 250/330
2007/0043541 A1 * 2/2007 Cleland ..... H05B 37/0281 702/188
2007/0216539 A1 * 9/2007 D'Antoni ..... G08G 1/0965 340/902
2008/0150755 A1 * 6/2008 Van Zandt ..... G08G 1/0965 340/902
2009/0001893 A1 * 1/2009 Cleland ..... H05B 41/40 315/151
2010/0315264 A1 * 12/2010 Tarolli ..... G08G 1/096 340/907
2012/0112927 A1 5/2012 Grieco et al.

OTHER PUBLICATIONS

U.S. Appl. No. 13/289,456, Final Office Action, Feb. 5, 2014, 18 pg.
U.S. Appl. No. 13/289,456, Examiner's Answer, Sep. 9, 2014, 11 pg.
U.S. Appl. No. 13/289,456, Decision on Appeal, Sep. 21, 2016, 10 pg.
U.S. Appl. No. 13/289,456, Non-Final Office Action, Dec. 23, 2016, 6 pg.
U.S. Appl. No. 13/289,456, Notice of Allowance, Feb. 6, 2017, 7 pg.

* cited by examiner

TRAFFIC LIGHT PREEMPTION MANAGEMENT SYSTEM

CROSS-REFERENCE TO RELATED APPLICATIONS

This application claims the benefit of European Patent Application Number 10190263.3 filed on Nov. 5, 2010, which is fully incorporated herein by reference. This application is a Continuation of U.S. application Ser. No. 13/289,456, filed on Nov. 4, 2011.

BACKGROUND

The present invention relates to a method and system for managing traffic lights at an intersection so as to facilitate the passage of a vehicle.

System for allowing traffic lights to be pre-empted by emergency vehicles are common. However they often require that the emergency vehicles are equipped with a specific radio device to operate the traffic light.

BRIEF SUMMARY

According to a first aspect of the present invention, there is provided a method for managing traffic lights comprising: receiving a route which is going to be taken by a vehicle, wherein the vehicle is equipped to emit a first signal having a predefined characteristic; identifying an intersection on the route, wherein means for sampling the signal emitted by said vehicle are arranged at the intersection; identifying a first traffic light controlling, at the intersection, the traffic going in the direction which will be followed by the vehicle when arriving at the intersection, according to the route; identifying a second traffic light controlling, at the intersection, the traffic going in another direction; receiving a signal sample corresponding to a sample of the first signal received by said sampling means; determining, from an analysis of the sampled signal, whether the vehicle is approaching; if the vehicle is approaching, instructing the second traffic light to change its state so as to block traffic and instructing the first traffic light to change its state so as to authorize traffic, so as to facilitate passage of the vehicle at the intersection.

An advantage of this aspect is that the invention can be implemented with little modification to existing infrastructure, thus minimizing the implementation cost of the invention. Moreover only one traffic light at the intersection needs to be equipped with the sampling means, regardless of the direction followed by the vehicle. A further advantage is that the vehicle does not need to perform any particular action to pre-empt the traffic light before it arrives. This is particularly advantageous as the vehicle may not know that a traffic light is close, as the traffic light may not be in its line of sight, and the vehicle may not be equipped with a GPS device.

In a first development of the first aspect, the method further comprises the step of determining, from an analysis of the signal sample, whether the vehicle is going away; and if the vehicle is going away, instructing the first and second traffic lights to resume normal behaviour.

An advantage of this aspect is that the impact on normal traffic conditions can be minimized, with very little delay.

In a second development of the first aspect, the step of determining whether the vehicle is approaching is a function of the measure of the Doppler Effect in the signal sample.

An advantage of this aspect is that minimal equipment at the traffic light and vehicle levels are needed to estimate vehicle movement with respect to the traffic light. This method is also robust and requires only network connectivity between the traffic light and the system managing the traffic lights, which usually already exists.

In a third development of the first aspect, the step of determining whether the vehicle is going away is a function of the measure of the Doppler Effect in the signal sample.

An advantage of this aspect is that it is robust to determine accurately and with little delay when the vehicle has passed the intersection.

In a fourth development of the first aspect, the first signal is an audio signal comprising a predefined frequency and the means for sampling comprise a microphone, optionally comprising a band pass filter centred on the predefined frequency.

An advantage is that the method does not require having line of sight between the traffic light and the vehicle for which passage at the intersection is being facilitated. Furthermore, as emergency vehicles would be the primary users of a system implementing the method and as such vehicles are usually equipped with a siren, deployment of this development would require little or no modification of existing vehicles and can be achieved at minimal cost.

In a fifth development of the first aspect, the first signal is a light signal pulsed at a predefined frequency and the means for sampling comprise a camera.

An advantage is that it is easy to determine the direction of the vehicle emitting the light signal.

In a sixth development of the first aspect, means for broadcasting a radio signal are arranged at the intersection, and the method comprises the further step of: instructing the means for broadcasting to broadcast a second signal comprising information about the approaching vehicle so that a radio system located within a close range of the traffic lights can receive the information.

An advantage is that notified vehicles can adapt their behaviour so as to facilitate the passage of the approaching vehicle.

In a seventh development of the first aspect, the information comprises the current GPS coordinates of the approaching vehicle; and/or an estimate of the current speed of the approaching vehicle so as to inform other vehicles, through their radio systems, of the current position and/or speed of the approaching vehicle.

An advantage is that other vehicles can adapt their behaviour in a very accurate manner.

According to a second aspect of the present invention, there is provided an apparatus comprising means adapted for carrying out each step of the method according to the first aspect of the invention.

An advantage is that this apparatus can be obtained very easily, thus making the method easy to execute.

According to a third aspect of the present invention, there is provided a computer program comprising instructions for carrying out the steps of the method according to a first aspect of the invention when the computer program is executed on a computer.

An advantage is that the invention can easily be reproduced and run on different computer systems.

According to a fourth aspect of the present invention, there is provided a computer readable medium having encoded thereon a computer program according to the third aspect of the invention.

An advantage is that this medium can be used to easily install the method on various apparatus.

Further advantages of the present invention will become clear to the skilled person upon examination of the drawings and detailed description. It is intended that any additional advantages be incorporated therein.

BRIEF DESCRIPTION OF THE SEVERAL VIEWS OF THE DRAWINGS

Embodiments of the present invention will now be described by way of example with reference to the accompanying drawings in which like references denote similar elements, and in which.

DETAILED DESCRIPTION

Figure 1:
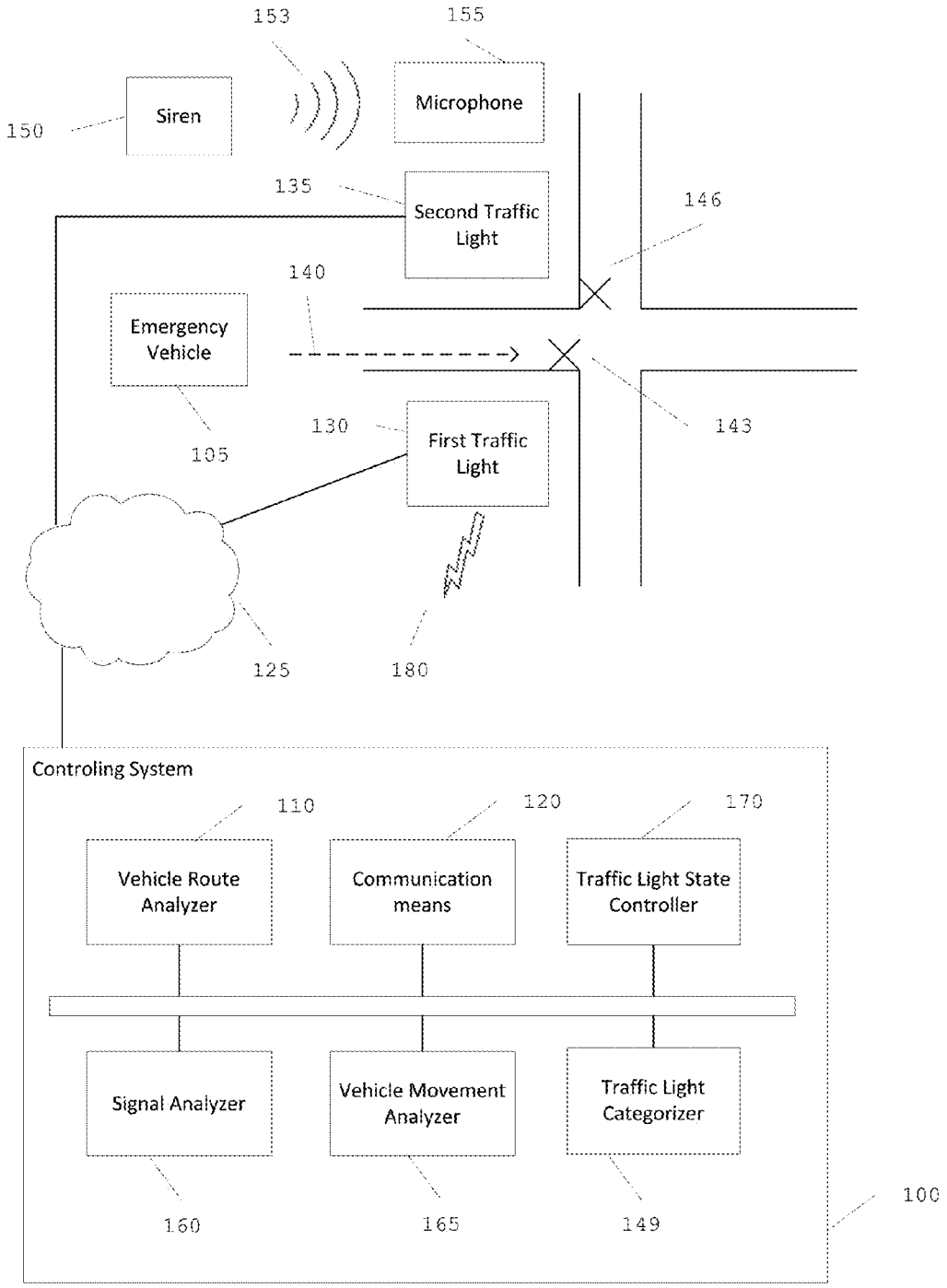
FIG. 1 shows an environment in which the present invention can operate along with a possible implementation of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk drive (HDD), a solid state drive (SSD), a random access memory (RAM), a read-only memory (ROM), an erasable programmable read-only memory (EPROM or Flash memory), an optical fiber, a portable compact disc read-only memory (CD-ROM), a digital versatile disc (DVD), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1 shows an environment in which the present system operates. A controlling system (100) comprises: a vehicle route analyzer (110); communication device (120); a traffic light state controller (170); a traffic light categorizer (149); a signal analyzer (160); and a vehicle movement analyzer (165). The controlling system (100) is connected to a first traffic light (130) and a second traffic light (135) through a network (125).

An emergency vehicle (105) is equipped with a siren (150). The emergency vehicle (105) is going to cross an intersection in a direction (140). The first traffic light (130)

controls the traffic in that direction (140) and is thus positioned at a corresponding location (143) on the road which the emergency vehicle (105) is going to take. The second traffic light (135) controls traffic going in another direction. This direction can be perpendicular to the direction (140) or parallel and opposite to the direction (140). The second traffic light (135) controls traffic in a direction perpendicular to direction (140) and is thus positioned at a corresponding location (146) on the road.

The first traffic light (130) includes a broadcasting device/transmitter configured to broadcast a radio signal (180). However the transmitter (180) can also be arranged or installed at the intersection separately from any traffic lights. The connectivity between the transmitter (180) and the network can be set through a traffic light or independently.

The second traffic light (135) comprises a sampling device for sampling an audio signal (153) such as the one emitted by the siren (150) and a microphone (155). However the sampling device (153) can also be arranged or installed at the intersection separately from any traffic lights. The connectivity between the sampling device (153) and the network can be set through a traffic light or independently. The first traffic light (130) and the second traffic light (135) are similar. The second traffic light (135) can comprise a transmitter like the first traffic light (130), and the first traffic light (130) can also comprise a sampling device like the second traffic light (135).

The destination of an emergency vehicle (105) is usually known, as it is in general set by a central service in response to emergency calls. The emergency vehicle (105) also indicates its current position on a regular basis so that, when an emergency arises, the central service can dispatch the available emergency vehicle closest to the destination. In one embodiment, the emergency vehicle (105) comprises a device configured to indicate its position on a regular basis. For example the emergency vehicle (105) can establish a wireless connection to the network (125), and send a message to the controlling system (100) through its communication device (120) with its current location information obtained for example from a GPS system.

The current location information of the emergency vehicle (105) can include its GPS coordinates and its speed. Furthermore the broadcasted information can indicate to drivers through car radio systems which action to do in case of an approaching emergency vehicle. Moreover the transmitter (180) can send another signal to cars equipped with GPS navigator displaying position of emergency vehicle and its declared route to let normal drivers perform the correct movement to leave the way free. The emergency vehicle driver also has the possibility to deliver specific message or instructions to cars in the surrounding area by speaking to the radio microphone tuned on the traffic light radio channel, in this way the traffic light transmitter will act as localized radio station. However it is not required that this information be provided to be able to control the traffic lights (130, 135).

Given the last known position of the emergency vehicle (105) and its destination, the vehicle route analyzer (110) component of the controlling system (100) can derive the most probable route which will be taken by the emergency vehicle (105). This route can also be communicated by the emergency vehicle (105) itself or mandated by the central service setting the destination of the emergency vehicle (105). Given the expected route, the vehicle route analyzer (110) identifies an intersection on the route, such as the one represented in FIG. 1, and identifies the traffic lights at such intersection. The types of intersections that the vehicle route analyzer (110) can analyse or that the controlling system (100) can manage are not limited to the ones represented in FIG. 1.

In one implementation, traffic lights at intersections with more than two roads can be managed. Traffic lights at roundabouts or even traffic lights where there is no intersection (this can happen for instance where there is a pedestrian crossing) can also be managed. Such a configuration of traffic lights will be called an intersection.

An implementation of the present system can comprise a traffic light categorizer (149) for determining which traffic light controls, at the intersection, the traffic going in the direction which will be followed by the vehicle when arriving at the intersection, according to the route. In FIG. 1, the first traffic light (130) is the one controlling traffic in that direction (140). The other traffic lights at the intersection, for example the second traffic light (135), control traffic going in another direction from the emergency vehicle (105) direction (140). When the emergency vehicle (105) approaches the intersection, the traffic light state controller (170) instructs the first traffic light (130) to change its state to authorize traffic (for example by displaying a green light) and the other traffic lights, including the second traffic light (135), to change their states to block traffic (for example by displaying a red light), so as to facilitate passage of the emergency vehicle (105) at the intersection.

Determining the right moment to change the states of the traffic lights can be important to achieve efficient management of the traffic conditions. It cannot be too early, i.e. too long before the emergency vehicle (105) arrives at the intersection. This could cause too big a disruption to traffic and can even be counterproductive as traffic in the direction (140) of the emergency vehicle (105) can be indirectly impacted. Furthermore, it should not be when the emergency vehicle (105) is too close to the intersection, as it would not save enough time for the emergency vehicle (105). Thus a trade-off is necessary.

An implementation of the present system relies on the signal, for instance an audio signal (153), a radio signal or a light signal, emitted by the emergency vehicle (105) to determine when to change the state of the traffic lights (130, 135). In an implementation of the present system, the signal (153) is received by the microphone (155) and sampled by the sampling device of the second traffic light (135). The gain of the sampling device can be tuned to adjust the distance at which the emergency vehicle (105) should be detected, with a larger gain enabling to detect the approach of the emergency vehicle (105) sooner, and a smaller gain enabling to detect the approach of the emergency vehicle (105) later.

The sampled signal is then sent by the sampling device, possibly through the second traffic light (135), to the controlling system (100) through the network (125). The receipt of the signal sample by the communication means (120) triggers the signal analyzer (160) to start the analysis of the sample. This component can apply various known signal processing techniques to the signal sample. In an implementation of the present system, the signal emitted by the emergency vehicle (105) comprises a predefined characteristic, such as a predefined audio or radio frequency, or a predefined light pulse pattern, and the vehicle movement analyzer (165) can determine whether the emergency vehicle (105) is approaching or going away from an analysis of the signal sample.

For example, in case of an audio signal as in FIG. 1, if the emergency vehicle (105) is approaching the intersection, the predefined frequency of the audio signal is transformed by the Doppler Effect when the audio signal is received by the microphone (155), and would sound with a higher pitch (and thus with a higher frequency). Conversely if the emergency vehicle (105) is going away, the audio signal would sound with a lower pitch (and thus with a lower frequency). The signal analyzer (160) can process the signal sample to isolate the perceived frequency. Then the vehicle movement analyzer (165) can compare the perceived frequency to the predefined frequency. If the perceived frequency is smaller, then the emergency vehicle (105) is going away, if it is greater than the emergency vehicle (105) is approaching. It is possible that the perceived frequency is the same as the predefined frequency because the emergency vehicle (105) is immobile. However, if the emitted signal is sampled regularly, on average, the perceived frequency will be either higher, or lower than the predefined frequency. And the first time a lower frequency is detected in a particular sample, it can be inferred with good confidence that the emergency vehicle (105) has crossed the intersection and is now going away from the intersection. The Doppler Effect can be easily measured on a large variety of signals at different frequencies. A particular advantage of relying on an audio signal is that they do not require any extra equipment that an emergency vehicle (105) already has (for example a siren (150)).

An implementation of the present system can also serve to manage traffic lights when other vehicles than an emergency vehicles, approach an intersection. These vehicles can be a train, a bus, or any vehicle which requires some priority over normal vehicles such as regular cars.

In the case of a light signal, a camera with 360° vision can be installed in the middle of the intersection to monitor incoming roads.

Figure 2:
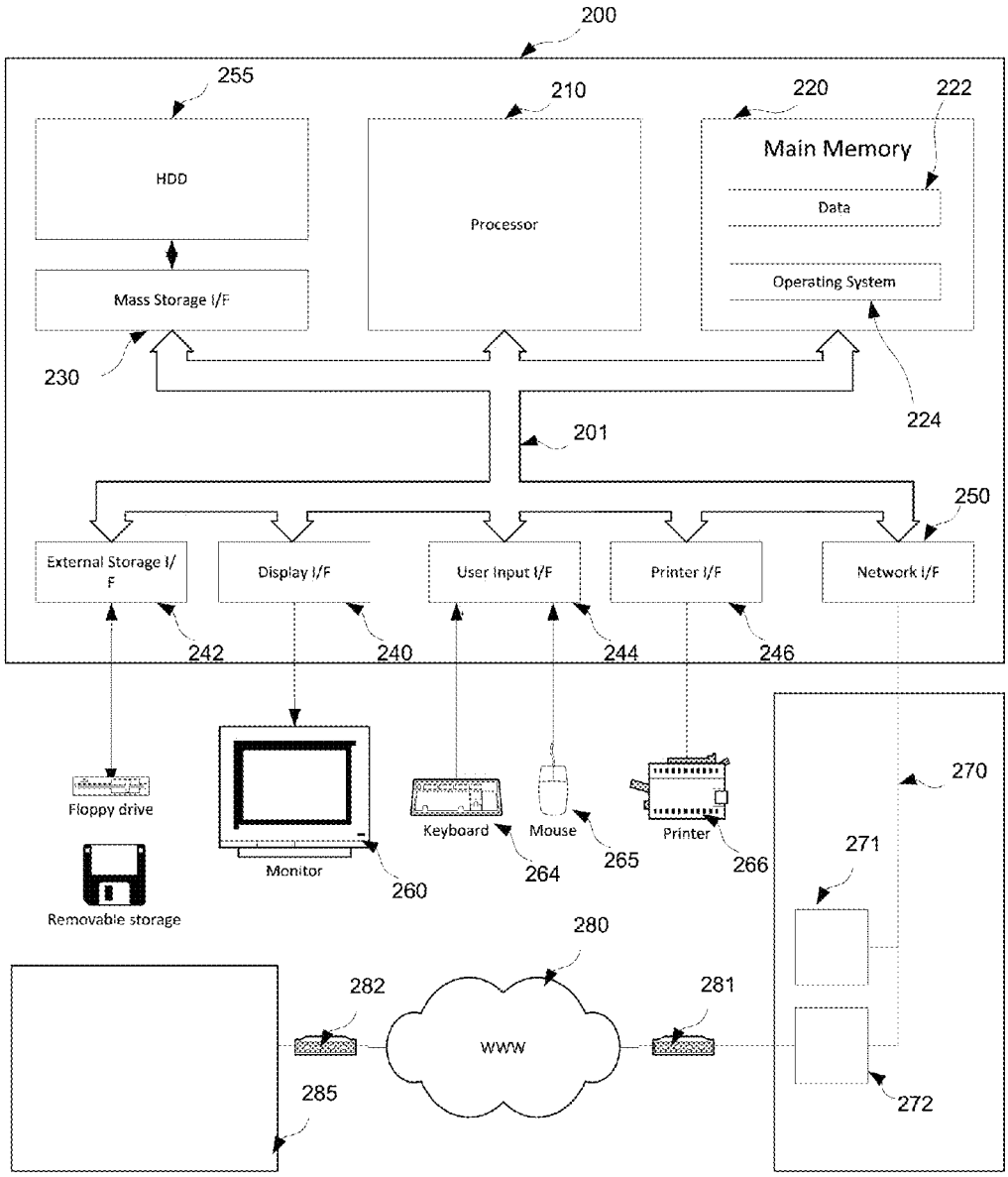
FIG. 2 shows a computer system in which the present invention can run.

FIG. 2 is a first block diagram illustrating a system (200) in which one embodiment of the present invention can run, for example the controlling system (100) described with respect to FIG. 1.

System (200) can include at least one processor (210) coupled to main memory elements (220), a mass storage interface (230), a display interface (240) and a network interface (250) through a system bus (201). As such, system (200) can store program code within memory elements (220). Processor (210) can execute the program code accessed from memory elements (220) via system bus (201). In one aspect, for example, system (200) can be implemented as computer that is suitable for storing and/or executing program code. It should be appreciated, however, that system (200) can be implemented in the form of any system comprising a processor and memory that is capable of performing the functions described within this specification.

Memory elements (220) can include one or more physical memory devices such as, for example, local data storage and one or more bulk storage devices. Local memory refers to random access memory or other non-persistent memory device(s) generally used during actual execution of the program code. Bulk storage device(s) can be implemented as a hard disk drive (255) or other persistent data storage devices. System (200) also can include one or more cache memories (not shown) that provide temporary storage of at least some program code in order to reduce the number of times program code must be retrieved from bulk storage device (255) during execution.

Input/output (I/O) devices such as a keyboard (264), a display (260), and a pointing device/mouse (265) optionally can be coupled to System (200). The I/O devices can be coupled to system (200) either directly or through intervening I/O controllers. Network adapters also can be coupled to system (200) to enable system (200) to become coupled to other systems, computer systems, remote printers, and/or remote storage devices through intervening private or public networks. Modems, cable modems, and Ethernet cards are examples of different types of network adapters that can be used with system (200).

As pictured in FIG. 2, system (200) utilizes well known virtual addressing mechanisms that allow the programs of system (200) to behave as if they only have access to a large, single storage entity instead of access to multiple, smaller storage entities such as main memory (220) and HDD (255). Therefore, while data (222) and operating system (224) are shown to reside in main memory (220), those skilled in the art will recognize that these items are not necessarily all completely contained in main memory (220) at the same time. It should also be noted that the term "memory" is used herein to generically refer to the entire virtual memory of computer system (200).

Data (222) represents any data that serves as input to or output from any program in system (200). Operating system (224) is a multitasking operating system known in the industry as OS/400; however, those skilled in the art will appreciate that the spirit and scope of the present invention is not limited to any one operating system.

Processor (210) may be constructed from one or more microprocessors and/or integrated circuits. Processor (210) executes program instructions stored in main memory (220). Main memory (220) stores programs and data that processor (210) may access. When computer system (200) starts up, processor (210) initially executes the program instructions that make up operating system (224). Operating system (224) is a sophisticated program that manages the resources of computer system (200). Some of these resources are processor (210), main memory (220), mass storage interface (230), display interface (240), network interface (250), and system bus (201).

Although computer system (200) is shown to contain only a single processor and a single system bus, those skilled in the art will appreciate that the present invention may be practiced using a computer system that has multiple processors and/or multiple buses. In addition, the interfaces that are used in the preferred embodiment each include separate, fully programmed microprocessors that are used to off-load compute-intensive processing from processor (210). However, those skilled in the art will appreciate that the present invention applies equally to computer systems that simply use I/O adapters to perform similar functions.

Display interface (240) is used to directly connect one or more displays (260) to computer system (200). These displays (260), which may be non-intelligent (i.e., dumb) terminals or fully programmable workstations, are used to allow system administrators and users to communicate with computer system (200). Note, however, that while display interface (240) is provided to support communication with one or more displays (260), computer system (200) does not necessarily require a display (265), because all needed interaction with users and other processes may occur via network interface (250).

Network interface (250) is used to connect other computer systems and/or workstations to computer system (200) across a network (270). The present invention applies equally no matter how computer system (200) may be connected to other computer systems and/or workstations, regardless of whether the network connection (270) is made using present-day analogue and/or digital techniques or via some networking mechanism of the future. In addition, many different network protocols can be used to implement a network. These protocols are specialized computer programs that allow computers to communicate across network (270). TCP/IP (Transmission Control Protocol/Internet Protocol) is an example of a suitable network protocol, for example over an Ethernet network. As shown, the network (270) connects the system (200) to two further devices (271) and (272), which may be other computer systems similar to that described above, or other network capable devices such as printers, routers etc. In the present example, network device (272) is a LCL server, which is connected via a modem (281) to a public network (280) such as the World Wide Web. By means of this public network (280) a connection to a remote device or system (285) may be established.

At this point, it is important to note that while the present invention has been and will continue to be described in the context of a fully functional computer system, those skilled in the art will appreciate that the present invention is capable of being distributed as a program product in a variety of forms, and that the present invention applies equally regardless of the particular type of signal bearing media used to actually carry out the distribution. Examples of suitable signal bearing media include: recordable type media such as floppy disks and CD ROM and transmission type media such as digital and analogue communications links.

Figure 3:
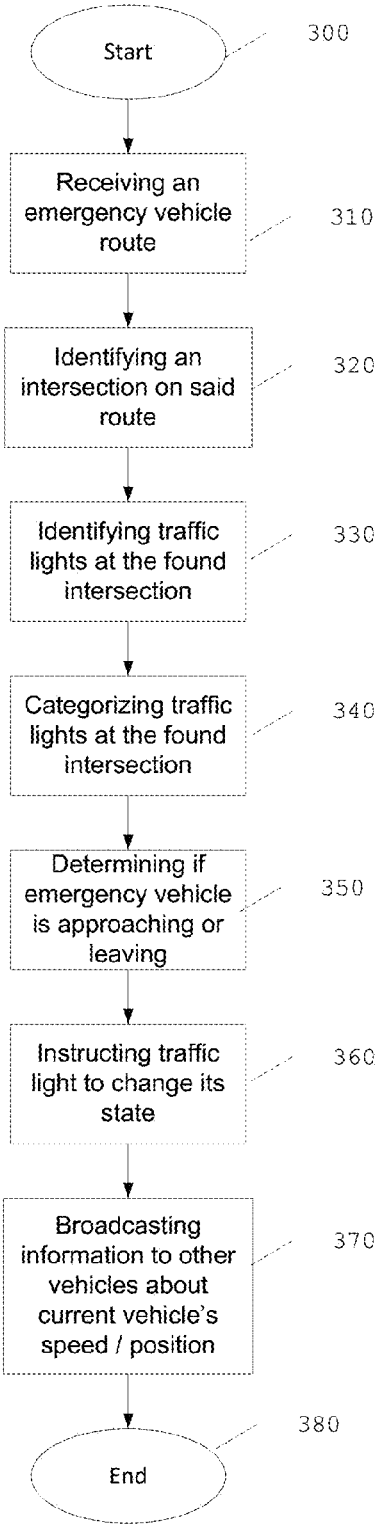
FIG. 3 shows an activity diagram with steps performed by an implementation of the present invention.

FIG. 3 shows an activity diagram with steps performed by an implementation of the present system. These steps includes a start state (300); the step of receiving an emergency route (310); the step of identifying an intersection on the route (320); the step of identifying traffic lights at the found intersection (330); the step of categorizing traffic lights at the found intersection (340); the step of determining if the emergency vehicle (105) is approaching or leaving (350); the step of instructing a traffic light to change its state (360); the step of broadcasting information to other vehicles about current vehicle speed or position (370); and an end state (380).

These steps can be executed by a controlling system described with respect to FIG. 1. The controlling system (100) would receive the emergency route (310) through the communication means (120). These communication devices (120) can receive messages from or send messages to any computer system connected through the network (125) to the controlling system (100). The vehicle route analyzer (110) would identify an intersection on the route (320) and identify traffic lights at the found intersection (340). The traffic light state controller (170) can categorise the traffic lights at the found intersection (340). The vehicle movement analyzer (165) would determine if the emergency vehicle is approaching or leaving (350), and the traffic light state controller (170) would instruct a traffic light to change its state accordingly (360). The controlling system (100) would further send a message using the communication device (120) to the broadcasting means at an intersection to instruct them to broadcast a signal comprising information about the approaching vehicle so that a radio system located within a close range of the traffic lights can receive the information.

Figure 4:
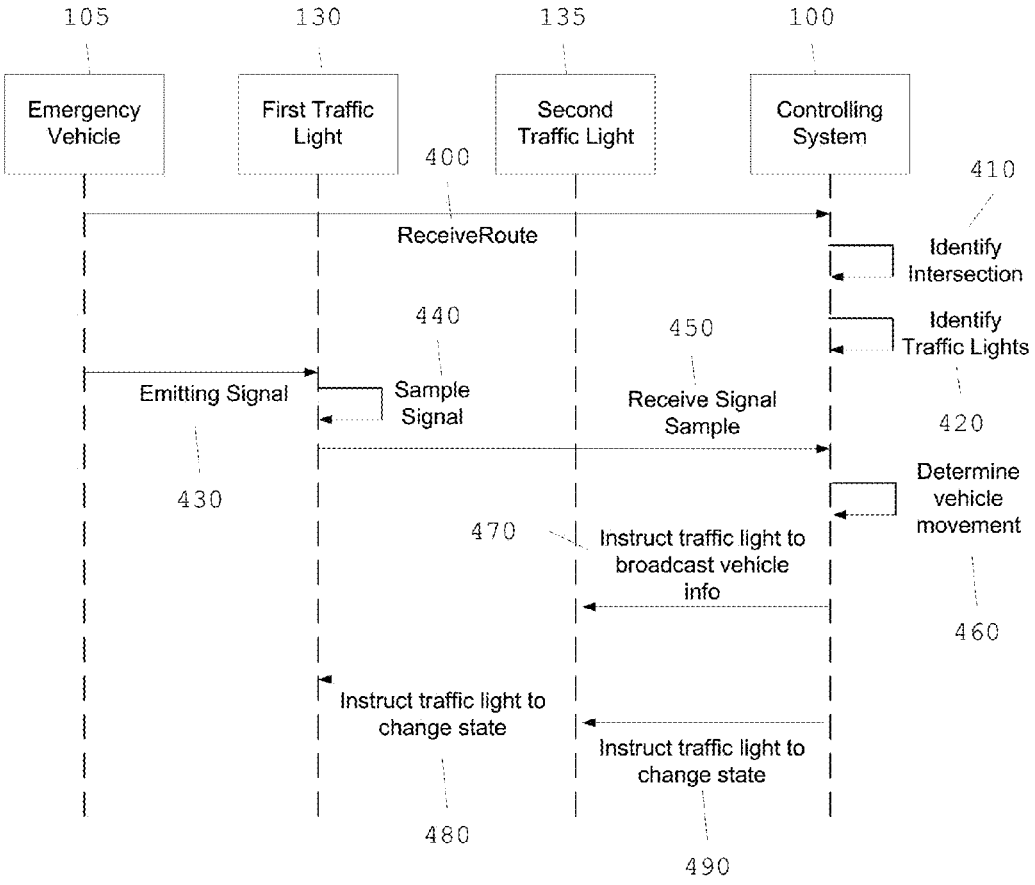
FIG. 4 shows a sequence diagram representing interactions between the vehicle, traffic lights, and an implementation of the present invention.

FIG. 4 shows a sequence diagram representing interactions between the vehicle, traffic lights, and an implementation of the present system, where: the controlling system (100) receives the route of the emergency vehicle (105) (400); the controlling system (100) then identifies an intersection on this route (410) and identify the traffic lights at this intersection (420); when the emergency vehicle (105) is close to a traffic light equipped with the sampling device (here the first traffic light (130)), its emitted signal (430) is sampled (440) as it is received by the sampling device and the signal sample is sent to the controlling system (100). The controlling system (100) then determines the vehicle movement (460), which is approaching or going away, and instruct the traffic lights to change their state accordingly (480, 490). The controlling system (100) can further instruct the broadcasting means to broadcast information about the vehicle, such as its position and speed (470).

Another embodiment comprises a method and system for managing a set of traffic lights at an intersection, measuring the Doppler Effect of a signal emitted by a vehicle, where such Doppler Effect being a function of the vehicle movement with respect to said intersection, and deciding as a function of such measure a new state for each traffic light at the intersection so as to facilitate passage of the approaching vehicle.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for managing traffic lights, comprising:

receiving, from a vehicle, a route to be taken by the vehicle;

identifying, based upon the received route, an intersection to be traversed by the vehicle and traffic lights at the intersection;

categorizing, based upon the received route, the traffic lights;

receiving, from the intersection, a first audio signal;

analysing the received first audio signal to determine movement of the vehicle;

sending, to traffic lights at the intersection and based upon the determined movement, the received route, and the categorizing of the traffic lights, instructions to change states; and sending, to a broadcasting device positioned at the interaction and based upon the received route and the determined movement, information about the vehicle to be broadcasted by the broadcasting device.

2. The method of claim 1, wherein the broadcasting device broadcasts, to radio systems within vehicles proximate to the interaction, the information about the vehicle.

3. The method of claim 2, wherein the broadcasting device broadcasts, to global positioning systems within the vehicles proximate to the interaction, the information about the vehicle.

4. The method of claim 3, wherein the information about the vehicle includes the route to be taken by the vehicle.

5. The method of claim 1, further comprising:

receiving, from the intersection, a second audio signal;

analysing the received second audio signal to determine additional movement of the vehicle; and sending, to traffic lights at the intersection and based upon the determined additional movement, additional instructions to change states.

* * * * *